United States Patent [19]

Besson

[11] Patent Number: 4,866,684

[45] Date of Patent: Sep. 12, 1989

[54] CHRONOMETER FOR STARTING RACES, PARTICULARLY REGATTAS

[75] Inventor: René Besson, Geneva, Switzerland

[73] Assignee: Montres Rolex, S.A., Geneva, Switzerland

[21] Appl. No.: 304,935

[22] Filed: Jan. 31, 1989

Related U.S. Application Data

[63] Continuation of Ser. No. 933,764, Nov. 20, 1986, abandoned.

[30] Foreign Application Priority Data

Nov. 22, 1985 [CH] Switzerland ..... 05001/85

[51] Int. Cl.[4] ..... G04F 8/00; G04B 19/04

[52] U.S. Cl. ..... 368/108; 368/228

[58] Field of Search ..... 368/76, 80, 107–113, 368/223, 228, 232

[56] References Cited

U.S. PATENT DOCUMENTS 4,494,879 1/1985 Meisner ..... 368/76

4,597,673 7/1986 Kihara ..... 368/80

FOREIGN PATENT DOCUMENTS 1959490 3/1964 Fed. Rep. of Germany .

0027250 4/1981 France .

483047 12/1969 Switzerland .

OTHER PUBLICATIONS

"Die Uhr" (The Watch), vol. 18, No. 5, pub. on 9/3/64.

*Primary Examiner*—Vit W. Miska

*Attorney, Agent, or Firm*—Davis, Bujold and Streck

[57] ABSTRACT

The chronometer comprises a face (11) having a first sector (14) which bears reference marks (12A) and a second sector (15) bearing reference marks (12B). A single hand is designed to move at a first speed between the starting point M of reference marks (12A) and the final point 30 of these reference marks and at a second speed between the starting point 30 of reference marks (12B) and the final point 0 of these reference marks. The displacement of the hand over the first sector lasts exactly nine minutes and thirty seconds. The displacement of the hand over the second sector lasts thirty seconds. This chronometer is specially designed to control the preparation time preceding the start of regattas.

4 Claims, 1 Drawing Sheet

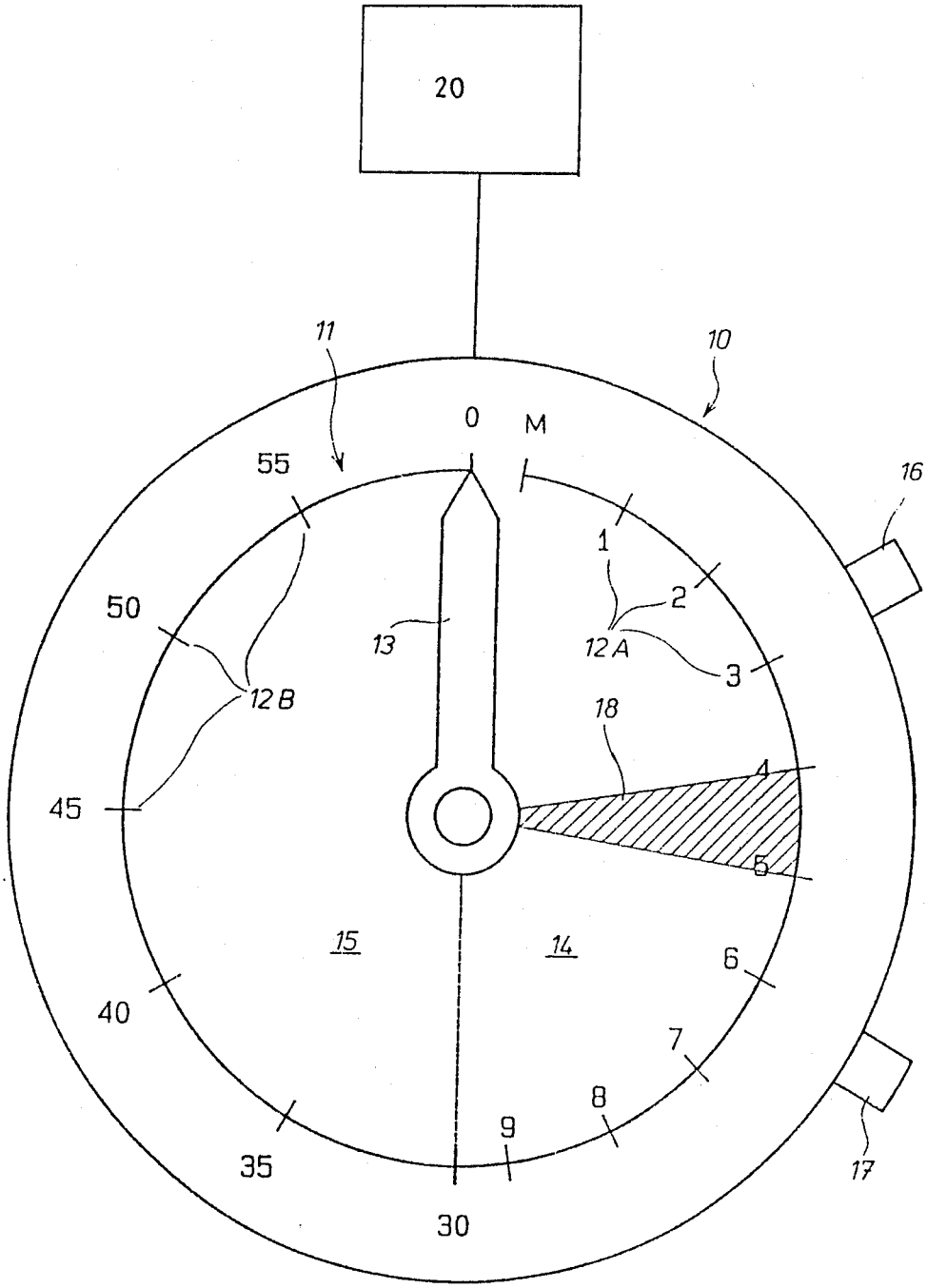
20
11
10
0
M
55
16
1
2
50
13
12 A
3
12 B
18
4
45
5
15
14
6
40
7
8
9
35
17
30

CHRONOMETER FOR STARTING RACES, PARTICULARLY REGATTAS

This is a continuation of co-pending application Ser. No. 06/933,764 filed on Nov. 20, 1986 now abandoned.

The present invention relates to a chronometer for starting races, especially regattas, comprising a case provided with a face bearing numerical reference marks, a single hand designed to move over the face and an electronic movement to drive this hand.

The rules of certain races, especially regattas, specify a preparation time enabling the competitors to get into position on the starting line. For this purpose, a regatta start is preceded by the emission of two optical signals respectively doubled by two gun shots spaced in time. The first emission of an optical signal takes place exactly ten minutes before the start and the second optical signal takes place exactly five minutes before this start. It is essential for the competitor to know precisely the starting time to the nearest second, so as to be able to cross the start line at the zero moment when the start of the regatta is given, with a boat whose sails are in the desired position and which have a sufficient area to gain a length over its neighbours so as to avoid dropping to leeward of the latter.

The competitors often use an ordinary watch equipped with a second hand to check the time which elapses between the optical signals and the moment the regatta starts. To do this, they regulate the watch so that the minute hand is situated exactly on a reference mark of the face at the moment of the first signal. The simultaneous observation of the minute hand and of the second hand enables the starting time to be located. However, such an observation is awkward and distracts the competitor who must be able to devote all his time and all his attention to his manoeuvres so as to be in a good position on the starting line at the moment the race starts. This attention is all the more necessary as these manoeuvres are often delicate, particularly because of the congestion of the starting zone and the risk of collision between competitors.

There are watches specially proposed for use by competitors in regattas. They have an optical device, in the form of coloured discs appearing in a window in the face, and allowing one to distinguish the first five minute period separating the first optical signal from the second, and the second five minute period separating the second optical signal from the start of the race. Furthermore they have a zero resetting device which enables the second hand to correspond with the 60 position at the moment one of the two luminous signals preceding the course appears. In order to obtain all information required by him, the competitor is obliged simultaneously to look at the optical device, the minute hand and the second hand, which involves the risk of distracting him during his maneuvers, as with an ordinary watch.

The object of the present invention is to provide the competitor with a precise, easily read instrument which enables him to control effectively the period between the emission of optical signals and the start of the race, without these controls requiring constant attention likely to distract him from the essential task, i.e. the maneuvers of the sails.

For this purpose, the chronometer according to the invention is characterised in that the face has at least two sectors, a first sector in which the reference marks are defined according to a first scale, and a second sector in which the reference marks are defined according to a second scale different from the first, and in that the movement is designed to displace the hand at difference speeds over the first and second sector, as is well known in the art.

The present invention will be better understood with reference to the description of an exemplified embodiment and to the attached drawing in which:

The single FIGURE shows a diagrammatic plan view of a preferred embodiment of the chronometer according to the invention.

With reference to the FIGURE, the chronometer described has a case 10 provided with a face 11 bearing numerical reference marks 12A and 12B, a single hand 13 and an electronic movement (not shown) to move the hand over the face. The numerical numbers 12A are distributed over a first sector 14 which corresponds to the right-hand semi-circle (on the FIGURE) and the numerical reference numbers 12B are disposed over a second sector 15 which corresponds to the left-hand semi-circle (on the FIGURE). Reference marks 12A have a starting point M, nine graduations numbered from 1 to 9 and a half-graduation bearing the number 30. The scale used on this first sector is the minute scale, and the speed of the displacement of the hand over this first sector is determined so that the path of the hand between the starting point M and the half-graduation 30 corresponds to a time period of nine minutes thirty seconds.

Reference marks 12B have a starting point which is in fact the half-graduation 30 of the first sector 14, a final point designated by the FIGURE 0 and five intermediate graduations bearing respectively the numbers 35, 40, 45, 50 and 55. The scale used on the second sector is the second scale, and the electronic movement is designed to drive the hand over this second sector at such a speed that the path of this hand between the starting point 30 and the final point 0 corresponds to a period of thirty seconds.

Moreover the chronometer comprises a tripping control device in the form of a push button 16, a synchronisation device which, in the example shown, is also formed by the push button 16, and a zero-resetting device in the form of a push button 17. It will be noted that the synchronization function which will be explained later could also be performed by a device independent from the push button 16.

In practice, the chronometer described may be a specific instrument, exclusively designed for competitors in a regatta, or may occur in the form of an additional device adapted to a traditional watch.

It will be noted that the starting point M of reference marks 12A is spaced from the final point 0 of reference marks 12B. This concept enables the competitor to visualise clearly and precisely the moment when the chronometer is started, and thus to avoid any risk of false interpretation. At the moment of the emission of the first optical signal preceding the race, i.e. ten minutes before the start, the crew member responsible for checking the time has to push the button 16, which has the effect of making hand 13 jump brusquely from its position of rest corresponding to the final point 0 of reference marks 12B borne by the second sector 15 to the starting point M of reference marks 12A borne by the first sector 14. From this starting point, the hand is driven by the electronic movement little by little every ten seconds by a conventional time control circuit 20 which is well known in the art. On a traditional face, one step represents ½ a second, which is adequate to guarantee the ½ minute, and indeed the 1/5 minute.

The first sector 14 has a hatched zone 18, corresponding for example to an angular sector situated between reference marks 4 and 5, called the synchronization zone. If the first optical signal has been badly perceived or if the crew, distracted by other maneuvers, was not able to trigger the start of the chronometer by pushing on the button 16 at the moment of the first optical signal, he may rectify this error by pushing a second time on the button 16 at the moment of the emission of the second optical signal. The effect of this is to bring the hand exactly into position on the reference mark bearing number 5. The hand then continues to turn at the same speed up to reference mark 30. From this moment, which informs the competitor that he has precisely thirty seconds until the offical start of the race, the hand changes speed and shows these last thirty seconds in a normal manner, i.e. just like the second hand of a watch or chronometer. When the hand arrives at the final point 0 of reference marks 12B of sector 15, the chronometer stops.

The push button 17 enables resetting to zero at any moment and regardless of the position of the hand, especially if the hand is not exactly opposite reference mark 0 before the start of a regatta.

It is clearly understood that this chronometer described in detail in connection with its use for the preparation of the start of a regatta could also be modified so as to make the start of other races easier for the competitors. In this case, its presentation should be modified depending on the rules of these races. It could be envisaged dividing the face into more than two sectors and driving the hand at different speeds over each of these sectors. Similarly the chronometer could be provided with other functions per se known such as sound signals enabling competitors to be informed of the course of the hand from one sector into the next sector, each of these corresponding to a specific preparation phase of the race.

I claim:

1. A method of moving a rotatably moveable single timing hand over a dial of a timing device at different desired first and second rotational speeds from a start point to an end point:

said dial being divided into first, second and third circumferentially sequential sectors, said first sector having said start point at one end thereof and, at an end thereof remote from said one end, joining said second sector, said second sector at an end thereof, remote from said first sector, having said end point, said first and second sectors having indicia indicating time, the indicia of said first sector being of a different scale from the indicia of said second sector, and said third sector separating said start point and said end point, comprising the steps of:

(b) moving said timing hand over said third sector to said start point from said stop point upon commencement of an event to be timed;

(c) rotating said timing hand over said first sector from said start point, immediately following commencement, at said first rotational speed consistent with the indicia in this sector;

(d) moving said timing hand to a desired position in said first sector to synchronize said hand with the event being timed;

(e) continuing rotation of said timing hand at said first rotational speed to said second sector;

(f) changing the rotational speed of said timing hand, as it moves from said first sector to said second sector, to said second rotational speed consistent with the indica in said second sector; and (g) stopping said timing hand when it reaches said end point.

2. A method according to claim 1 wherein said second rotational speed is faster than said first rotational speed.

3. A method according to claim 1 wherein said dial is divided into two equal circumferential arcs, said first and third sectors forming one said arc and said second sector forming the other said arc, and the first rotational speed being such that the timing hand requires 9 minutes and 30 seconds to rotate over the first sector and the second rotational speed being such that the timing hand requires 30 seconds to rotate over the second sector.

4. A method according to claim 2 comprising marking a zone preceding, relative to the direction of hand movement, said desired position to alert an operator, when said single hand is positioned over said zone, that the need for said synchronization is imminent.

* * * * *